US012152458B1

(12) United States Patent
Zonoz et al.

(10) Patent No.: US 12,152,458 B1
(45) Date of Patent: Nov. 26, 2024

(54) PACKER ASSEMBLY FOR BLOWOUT PREVENTER

(71) Applicant: Schlumberger Technology Corporation, Sugar Land, TX (US)

(72) Inventors: Ray Zonoz, Sugar Land, TX (US); Xuming Chen, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/480,199

(22) Filed: Oct. 3, 2023

(51) Int. Cl.
*E21B 33/06* (2006.01)

(52) U.S. Cl.
CPC ..... *E21B 33/06* (2013.01)

(58) Field of Classification Search
CPC ..... E21B 33/06
See application file for complete search history.

(56) References Cited

U.S. PATENT DOCUMENTS 3,323,773 A * 6/1967 Walker ..... E21B 33/06 277/327
3,561,723 A * 2/1971 Cugini ..... E21B 33/085 277/327
3,591,125 A * 7/1971 Lewis ..... E21B 33/06 251/1.2
3,917,293 A * 11/1975 Lewis ..... E21B 33/06 251/1.2
2005/0072566 A1* 4/2005 Borden ..... E21B 33/06 166/126
2017/0254167 A1* 9/2017 Carbaugh ..... B29C 65/70
2018/0245419 A1* 8/2018 Mireles ..... E21B 33/06
2018/0334876 A1* 11/2018 Zonoz ..... E21B 33/085
2021/0087900 A1* 3/2021 Zonoz ..... E21B 33/06
2021/0207450 A1 7/2021 Mireles

OTHER PUBLICATIONS

Chen et al., Fatigue performance of metal-elastomer adhesion, presented at the Meeting of the Rubber Division, American Chemical Society, Louisville, KY, Oct. 9-11, 2018, 23 pages.

* cited by examiner

*Primary Examiner* — Matthew R Buck
(74) *Attorney, Agent, or Firm* — Kelly McKinney

(57) ABSTRACT

A packer for a blowout preventer includes an elastomer body and one or more inserts coupled to the elastomer body. At least one insert of the one or more inserts includes an insert body with an elastomer-contacting surface and one or more fixed extensions that extend from the elastomer-contacting surface to engage the elastomer body.

15 Claims, 6 Drawing Sheets

PACKER ASSEMBLY FOR BLOWOUT PREVENTER

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below a surface of the earth, drilling systems are often employed to carry out drilling operations to access the desired resource. The drilling systems generally include a wellhead mounted above a wellbore of a well. During the drilling operations and/or during other operations, a pressure control valve (e.g., at least one blowout preventer [BOP], such as an annular BOP and/or a ram BOP) is mounted above the wellhead to protect other well equipment from surges in pressure within the wellbore.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below In certain embodiments, a packer for a blowout preventer includes an elastomer body and one or more inserts coupled to the elastomer body. At least one insert of the one or more inserts includes an insert body with an elastomer-contacting surface and one or more fixed extensions that extend from the elastomer-contacting surface to engage the elastomer body.

In certain embodiments, an insert for a packer of a blowout preventer (BOP) includes an insert body with a radially inner surface, a first side surface, and a second side surface. At least one of the radially inner surface, the first side surface, or the second side surface includes one or more fixed indentations, one or more fixed extensions, or any combination thereof to facilitate engagement with an elastomer body of the packer.

In certain embodiments, an insert for a packer of a blowout preventer (BOP) includes an insert body and one or more movable extensions that are configured to move between a retracted configuration in which the one or more movable extensions are withdrawn into the insert body and an extracted configuration in which the one or more movable extensions extend from the insert body.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
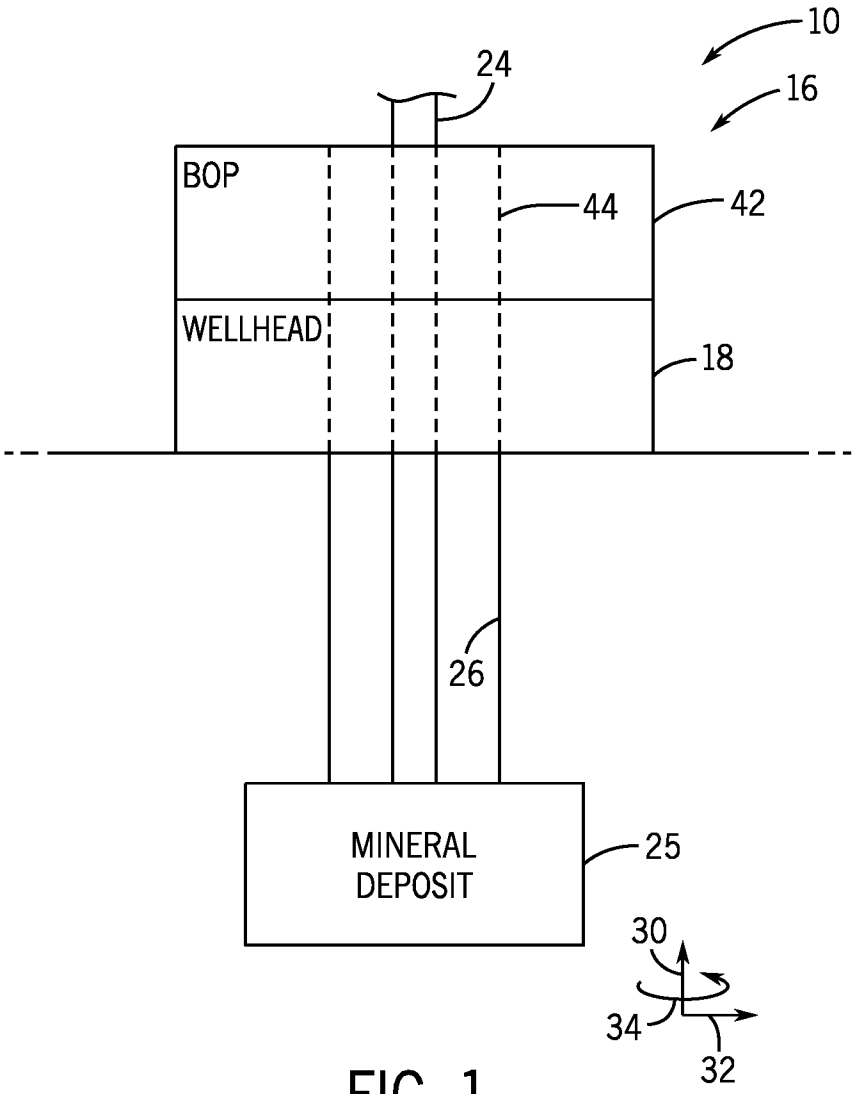
FIG. 1 is a block diagram of a system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments generally relate to a packer that may be utilized in a blowout preventer (BOP). For example, an annular BOP may be installed on a wellhead. During drilling operations, a drill string may extend from a rig, through the annular BOP, through the wellhead, and into a wellbore. A drilling fluid may be delivered through the drill string and returned up through an annulus between the drill string and a casing that lines the wellbore. The annular BOP may be actuated to seal the annulus and to control fluid pressure in the wellbore, thereby protecting other well equipment above the annular BOP.

The annular BOP may include a packer (e.g., annular packer or annular packer assembly) within a housing (e.g., an annular housing). A piston (e.g., annular piston) may be adjusted in a first direction to drive the packer from an open configuration to a closed configuration to seal the annulus around the drill string disposed through a central bore of the annular BOP and/or to close the central bore. The packer may include an elastomer body (e.g., annular elastomer body, annular packer body, or annular elastomer packer body) and one or more inserts (e.g., rigid inserts) coupled to (e.g., bonded) and/or positioned within the elastomer body. The one or more inserts may have structural features that facilitate operation of the annular BOP. For example, the one or more inserts may include fixed structural features (e.g., fixed surface features; fixed indentations, such as fixed troughs and/or openings; fixed extensions, such as fixed protrusions and/or fixed ribs) that facilitate adhesion and/or engagement between the elastomer body and the one or more inserts. Additionally or alternatively, the one or more inserts may include movable structural features (e.g., movable extensions, such as movable ribs) that facilitate adhesion and/or engagement between the elastomer body and the one or more inserts. By improving adhesion and/or engagement (e.g., more force is needed to separate or to peel the elastomer body away from the one or more inserts as compared to existing packers without the one or more structural features disclosed herein), the packer may have improved operation (e.g., closure), increased service life (e.g., withstand more open/close cycles), and/or reduced wear (e.g., less cracks and/or tearing of structures), for example.

With the foregoing in mind, FIG. 1 is a block diagram of an embodiment of a system 10 (e.g., drilling system). The system 10 may be configured to access and/or extract various minerals and natural resources (e.g., hydrocarbons, such as oil and/or natural gas), for example. The system 10 may be a land-based system (e.g., surface system) or an offshore system (e.g., offshore platform system).

As shown, a BOP assembly 16 is mounted to a wellhead 18, which is coupled to a mineral deposit 25 via a wellbore 26. The wellhead 18 may be coupled to and/or include any of a variety of other components, such as a spool, a hanger, and a "Christmas" tree. Downhole operations are carried out by a tubular string 24 (e.g., drill string) that extends through the BOP assembly 16, through the wellhead 18, and into the wellbore 26. To facilitate discussion, the BOP assembly 16 may be described with reference to an axial axis or direction 30, a radial axis or direction 32, and a circumferential axis or direction 34.

The BOP assembly 16 may include one or more annular BOPs 42. A central bore 44 (e.g., flow bore) extends through the one or more annular BOPs 42. Each of the one or more annular BOPs 42 includes a packer (e.g., annular packer or annular packer assembly) that is configured to be mechanically squeezed radially inward to seal about the tubular string 24 extending through the central bore 44 (e.g., to block an annulus about the tubular string 24) and/or to block flow through the central bore 44. As discussed in more detail herein, the packer may include one or more inserts that have structural features (e.g., one or more extensions) to facilitate adhesion and/or engagement with an elastomer body (e.g., annular elastomer body, annular packer body, or annular elastomer packer body) of the packer.

Figure 2:
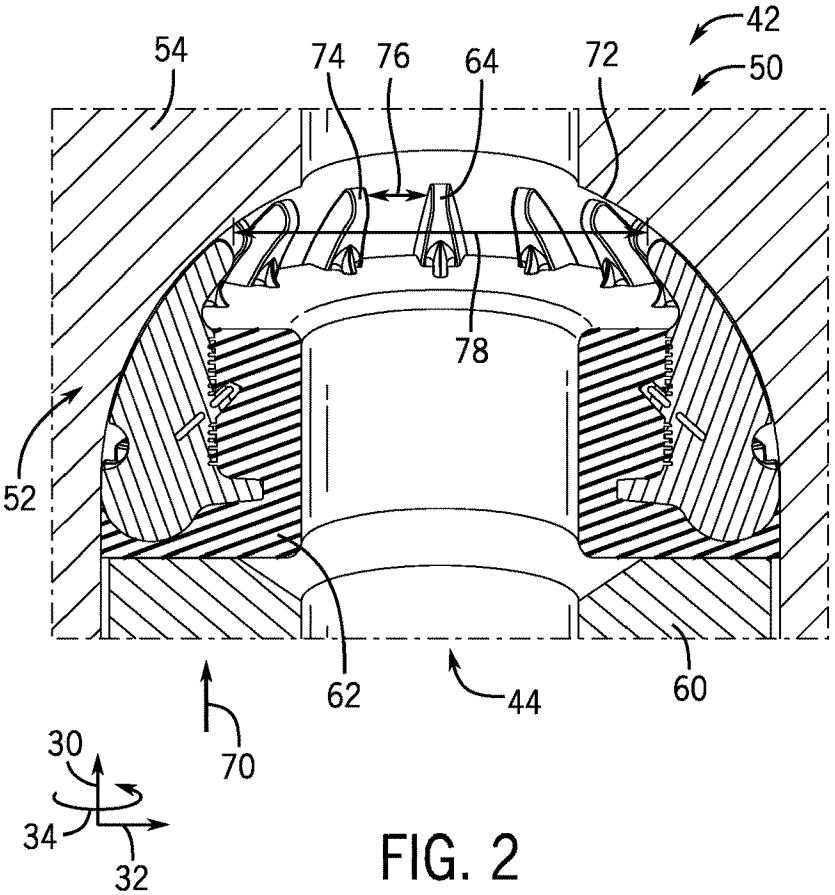
FIG. 2 is a cross-sectional side view of a portion of an annular BOP that may be used in the system of FIG. 1, wherein the annular BOP is in an open configuration, in accordance with an embodiment of the present disclosure.

FIG. 2 is a cross-sectional side view of an embodiment of a portion of the annular BOP 42 that may be used in the system 10 of FIG. 1. In FIG. 2, the annular BOP 42 is in an open configuration 50. In the open configuration 50, fluid may flow through the central bore 44 of the annular BOP 42. The annular BOP 42 includes a housing 54 (e.g., annular housing). A piston 60 (e.g., annular piston) and a packer 52 (e.g., annular packer or annular packer assembly) are positioned within the housing 54. The packer 52 includes an elastomer body 62 (e.g., annular elastomer body, annular packer body, or annular elastomer packer body) and inserts 64 (e.g., annularly arranged inserts; at discrete locations circumferentially about the elastomer body 62). The elastomer body 62 may be a flexible component (e.g., elastomer or rubber material) and the inserts 64 may be rigid (e.g., metal material, including metal alloy material; a rigid polymeric material). The elastomer body 62 may be bonded to the inserts 64 (e.g., to certain portions of each of the inserts 64; via adhesive).

In operation, the piston 60 is configured to move relative to the housing 54 in the axial direction 30. For example, a fluid (e.g., a liquid and/or gas) may be provided to a chamber to drive the piston 60 upwardly within the housing 54, as shown by arrow 70. As the piston 60 moves upwardly within the housing 54, the piston 60 drives the packer 52 upwardly within the housing 54. In FIG. 2, the housing 54 includes a radially inner surface 72 (e.g., curved annular surface, dome-shaped surface, or semi-spherical surface). Thus, as the piston 60 drives the packer 52 upwardly within the housing 54 and against the radially inner surface 72 of the housing 54, the radially inner surface 72 of the housing 54 directs the packer 52 to move inwardly in the radial direction 32.

In any case, when the packer 52 moves upwardly in the axial direction 30 and inwardly in the radial direction 32 within the housing 54, the packer 52 may transition to or reach a closed configuration in which the packer 52 contacts and forms a seal about the tubular string 24 extending through the central bore 44 and/or blocks flow through the central bore 44. In some embodiments, a fluid (e.g., a liquid and/or gas) may be provided to a chamber to drive the piston 60 downwardly within the housing 54 (e.g., opposite of the arrow 70), thereby causing the packer 52 to transition to or reach the open configuration 50. It should be appreciated that the housing 54 and the piston 60 may have any of a variety of shapes and/or configurations to enable the packer 52 to move between the open configuration 50 and the closed configuration.

As shown, the elastomer body 62 is in a relaxed configuration and the one or more inserts 64 are in an expanded configuration while the annular BOP 42 is in the open configuration 50. In the expanded configuration, respective first ends 74 (e.g., upper end portions or tips) of adjacent inserts 64 are separated by a first distance 76 (e.g., along the circumferential axis 34). Additionally, opposed respective first ends 74 of opposed inserts 64 (e.g., diametrically opposed on opposite sides of the central bore 44) define a first diameter 78 (e.g., along the radial axis 32). The first distance 76 between the respective first ends 74 of the adjacent inserts 64 and the first diameter 78 between the respective first ends 74 of the opposed inserts 64 may decrease as the annular BOP 42 moves from the open configuration 50 to the closed configuration.

Figure 3:
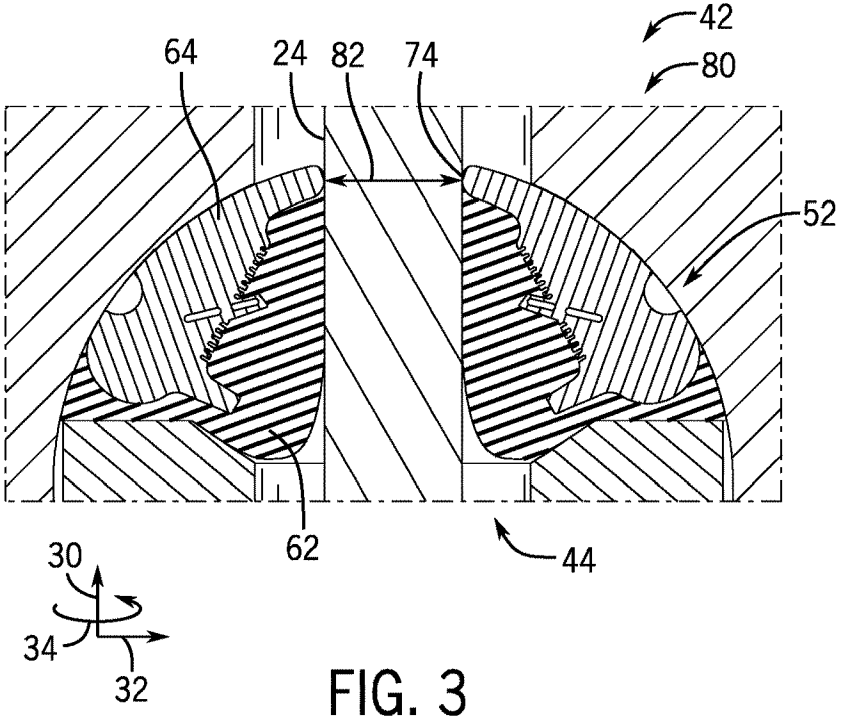
FIG. 3 is a cross-sectional side view of the portion of the annular BOP of FIG. 2, wherein the annular BOP is in a closed configuration, in accordance with an embodiment of the present disclosure.

FIG. 3 is a cross-sectional side view of an embodiment of the portion of the annular BOP 42 in a closed configuration 80. In the closed configuration 80, the packer 52 contacts and forms the seal about the tubular string 24 extending through the central bore 44 and/or closes the central bore 44, thereby blocking flow through the central bore 44. Further, the elastomer body 62 is in a compressed configuration and the one or more inserts 64 are in a contracted configuration while the annular BOP 42 is in the closed configuration 80. In the contracted configuration, the respective first ends 74 of the adjacent inserts 64 are separated by a second distance (e.g., along the circumferential axis 34) that is less than the first distance 76 shown in FIG. 2, and the opposed respective first ends 74 of the opposed inserts 64 define a second diameter 82 (e.g., along the radial axis 32) that is less than the first diameter 78 shown in FIG. 2.

To move from the open configuration 50 of FIG. 2 to the closed configuration 80 of FIG. 3, the piston 60 drives the packer 52 upwardly within the housing 54 and against the radially inner surface 72 of the housing 54. In certain embodiments, at least certain portions of the one or more inserts 64 contact the radially inner surface 72 of the housing 54, such that the one or more inserts 64 are directed radially inward along the radial axis 32 to contact one another, to contact the tubular string 24, and/or to support the elastomer body 62 in the central bore 44. As discussed in more detail herein, the one or more inserts 64 may include structural features (e.g., extensions) to facilitate adhesion and/or engagement with the elastomer body 62.

Figure 5:
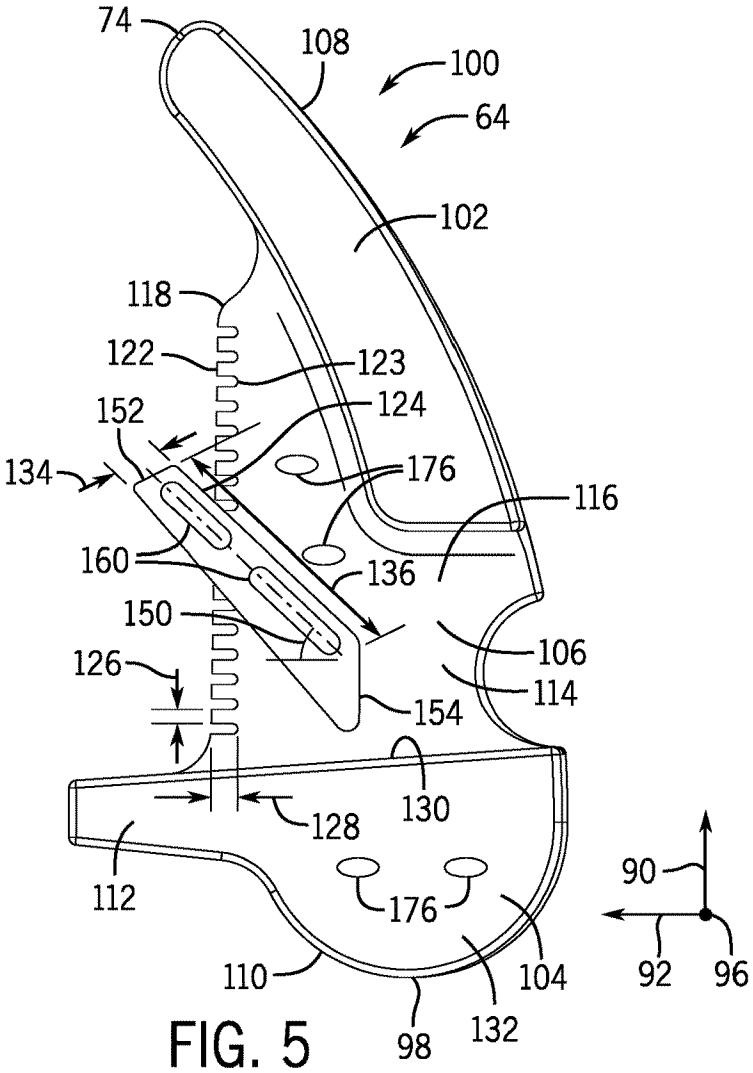
FIG. 5 is a side view of the insert of FIG. 4, in accordance with an embodiment of the present disclosure.
Figure 4:
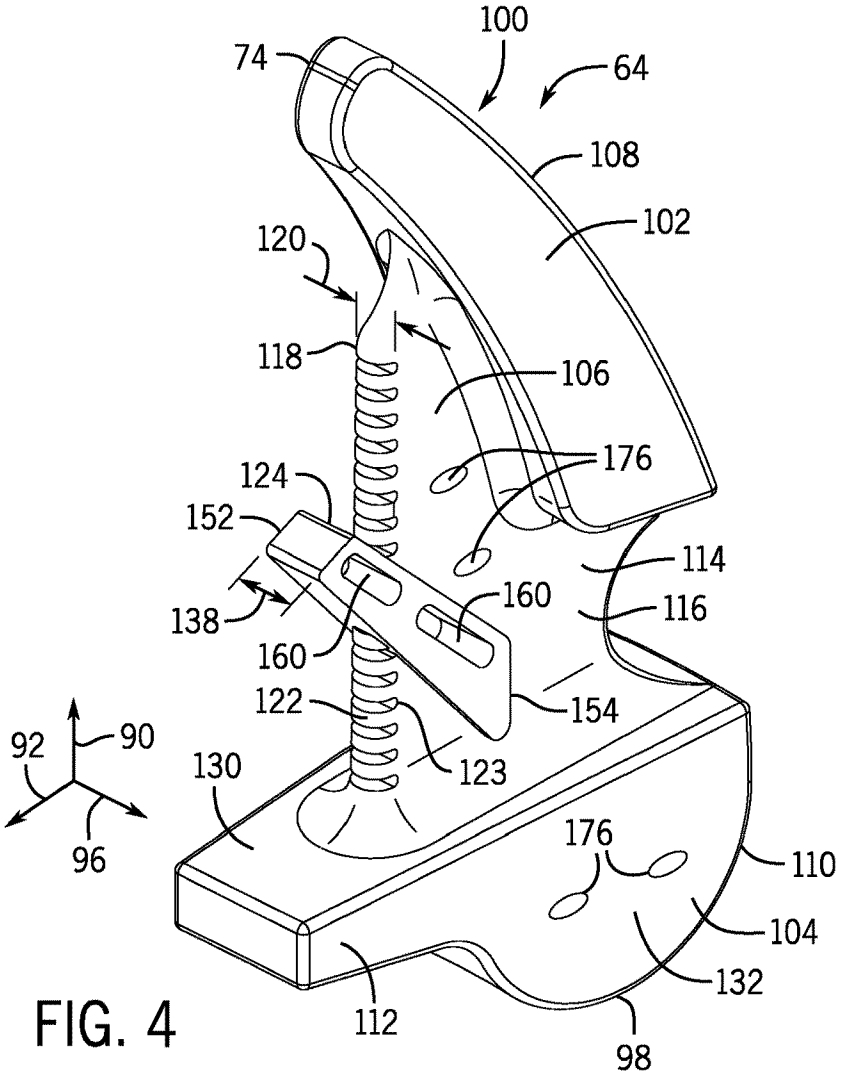
FIG. 4 is a perspective view of an insert that may be utilized in a packer of the annular BOP of FIG. 2, in accordance with an embodiment of the present disclosure.

FIG. 4 is a perspective view and FIG. 5 is a side view of an embodiment of one of the inserts 64 (also referred to herein as "the insert"). To facilitate discussion, the insert 64 may be described with reference to an axial axis or direction 90, a radial axis or direction 92, and a lateral axis or direction 96. With reference to FIGS. 2-5, when the insert 64 is coupled to the elastomer body 62 to form the packer 52, and when the packer 52 is placed within the annular BOP 42 in the open configuration 50, the axial axes 30, 90 may generally or substantially align and the radial axes 32, 92 may generally or substantially align.

As shown, the insert 64 may extend from the first end 74 to a second end 98 (e.g., lower end portion). Additionally, the insert 64 may include a body 100 with a sealing portion 102 that includes the first end 74, a base portion 104 that includes the second end 98, and an intermediate portion 106 that extends between and couples the sealing portion 102 to the base portion 104. In some embodiments and as shown in FIGS. 2 and 3, the base portion 104 and the intermediate portion 106 are configured to be disposed within (e.g., surrounded by) the elastomer body 62, and at least a portion of the sealing portion 102 is configured to be positioned external to or flush with the elastomer body 62. As such, the sealing portion 102 may be configured to directly contact the radially inner surface 72 of the housing 54 as shown in FIGS. 2 and 3.

The sealing portion 102 may include a tapered geometry (e.g., a wedge-shape or pie-shape; smaller width along the lateral axis 96 proximate to the first end 74 as compared to distal from the first end 74) to enable or to facilitate movement toward and/or contact with the adjacent inserts 64 when the packer 52 is in the closed configuration 80 shown in FIG. 3. Additionally, the sealing portion 102 may include a radially outer surface 108 with a respective curvature that generally corresponds to a respective curvature of the radially inner surface 72 of the housing 54 shown in FIGS. 2 and 3.

The base portion 104 may include a tapered geometry (e.g., a wedge-shape or pie-shape; smaller width along the lateral axis 96 proximate to a radially inner ledge 112 as compared to distal from the radially inner ledge) to enable or to facilitate movement toward and/or contact with the adjacent inserts 64 when the packer 52 is in the closed configuration 80 shown in FIG. 3. The base portion 104 may include a curved lower surface 110 to enable or to facilitate a pivoting movement of the insert 64 about the base portion 104, which in turn enables or facilitates movement of the first end 74 radially inwardly to reach the closed configuration 80 shown in FIG. 3. The base portion 104 also includes the radially inner ledge 112, which may extend radially inwardly to support the elastomer body 62 of the packer 52 of FIGS. 2 and 3.

The intermediate portion 106 may include an intermediate body portion 114 with side surfaces 116 (e.g., laterally facing surfaces; opposed sides; a first side surface and a second side surface) and a radially inner surface 118 (e.g., edge). A width 120 of the intermediate body portion 114 of the intermediate portion 106 (e.g., along the lateral axis 96) may be less than respective widths of the sealing portion 102 and/or the base portion 104, which may facilitate engagement with the elastomer body 62 of FIGS. 2 and 3 as the elastomer body 62 may engage radially facing surfaces and/or axially facing surfaces of the sealing portion 102 and/or the base portion 104, for example.

Advantageously, the insert 64 includes one or more structural features to facilitate adhesion and/or engagement with the elastomer body 62, as well as to support the elastomer body 62 during operation (e.g., in the closed configuration 80 of FIG. 3). The one or more structural features may include one or more extensions, such as one or more fixed extensions. In FIGS. 4 and 5, the one or more fixed extensions include one or more fixed protrusions 122 and/or one or more fixed ribs 124. The one or more fixed protrusions 122 may include multiple fixed protrusions 122 formed or defined along the radially inner surface 118 of the intermediate body portion 114 of the intermediate portion 106 of the insert 64. For example, the one or more fixed protrusions 122 may include the multiple fixed protrusions 122 that define a pattern (e.g., wave pattern; undulations) formed by alternating fixed protrusions 122 and fixed grooves 123 (e.g., notches), as best shown in the side view of the insert 64 of FIG. 5. It should be appreciated that the one or more fixed protrusions 122 may be described as the multiple fixed protrusions 122 that extend from the radially inner surface 118, the multiple fixed grooves 123 formed in the radially inner surface 118, the alternating fixed protrusions 122 and fixed grooves 123 along the radially inner surface 118, or any suitable terms (e.g., that describe the pattern or geometry depicted in FIGS. 4 and 5). In any case, the one or more fixed protrusions 122 may include the multiple fixed protrusions 122 stacked along the axial axis 90 and along the radially inner surface 118.

The one or more fixed protrusions 122 may have any suitable size and/or scale relative to the insert 64. For example, the one or more fixed protrusions 122 may be macrotextures with each protrusion 122 having a respective height 126 extending at least about 1, 2, 3, 4, 5, 6, 7, 8, 9, 10, 11, or 12 millimeters (mm) along the axial axis 90 or between about 1 to 12, 2 to 10, 3 to 8, or 4 to 6 mm along the axial axis 90. In certain embodiments, the respective height 126 may be at least about 0.5, 1, 2, 3, 4, or 5 percent of a total height of the insert 64 along the axial axis 90 or between about 0.5 to 5 or 1 to 4 percent of the total height of the insert 64 along the axial axis 90. In certain embodiments, the one or more fixed protrusions 122 may be macrotextures with each protrusion 122 having a respective depth 128 extending at least about 1, 2, 3, 4, 5, 6, 7, 8, 9, 10, 11, or 12 mm along the radial axis 92 or between about 1 to 12, 2 to 10, 3 to 8, or 4 to 6 mm along the radial axis 92. In certain embodiments, the respective depth 128 may be at least 1, 2, 3, 4, 5, 10, 15, 20, or 25 percent of a total radial depth of the insert 64 along the radial axis 92 or between about 1 to 25 or 5 to 20 percent of the total radial depth of the insert 64 along the radial axis 92.

The one or more fixed protrusions 122 may include any number of protrusions 122, such as 5, 10, 15, 20, or more (e.g., arranged in any suitable pattern, such as stacked in the wave pattern along the axial axis 90; the alternating fixed protrusions 122 and fixed grooves 123 along the axial axis 90). While the one or more fixed protrusions 122 are shown along the radially inner surface 118, it should be appreciated that the one or more fixed protrusions 122 may be provided along any suitable surface, such as any surface of the insert 64 that contacts and/or is adhered to the elastomer body 62 when assembled together as the packer 52 of FIGS. 2 and 3 (e.g., any elastomer-contacting surface of the insert 64). For example, the one or more fixed protrusions 122 may be provided along the side surfaces 116 of the intermediate body portion 114 of the intermediate portion 106, along an axially facing surface 130 of the base portion 104, along one or more side surfaces 132 of the base portion 104, along one or more surfaces of the seal portion 102, and so forth.

Further, while the one or more fixed protrusions 122 are shown as being oriented to face (e.g., open) radially inwardly and to extend across the width 120 of the intermediate body portion 114 of the intermediate portion 106, it should be appreciated that the one or more fixed protrusions 122 may be oriented in any suitable direction relative to the insert 64. For example, the one or more fixed protrusions 122 may be oriented to face laterally and/or to extend along the radial axis 92 (e.g., when placed along the side surfaces 116, 130). As another example, the one or more fixed protrusions 122 may be oriented to face axially and/or to extend along the radial axis 92 (e.g., when placed along the axially facing surface 130). Additionally or alternatively, the one or more fixed protrusions 122 may be oriented to face and/or extend at an angle, such as relative to the axial axis 90, the radial axis 92, and/or the lateral axis 96 (e.g., face at an angle upwardly or downwardly relative to the radial axis 92 or extend in the axial direction 90; and/or the angle may be from left or right relative to the axial axis 90 or extend in the lateral direction 96). The one or more fixed protrusions 122 may also include a variety of different sizes, shapes, and/or orientations across the insert 64.

As shown, the one or more fixed ribs 124 include a single fixed rib 124 (also referred to herein as "the fixed rib"). In FIGS. 4 and 5, the fixed rib 124 ends radially inwardly from the radially inner surface 118 of the intermediate body portion 114 of the intermediate portion 106 of the insert 64. The fixed rib 124 may have any suitable size and/or scale relative to the insert 64 and/or relative to the one or more fixed protrusions 122. For example, the fixed rib 124 may be a macrotexture and may be defined by a respective height 134, a respective depth 136, and/or a respective width 138. The fixed rib 124 may be larger than the one or more fixed protrusions 122 (e.g., with respect to height, depth, and/or width).

The fixed rib 124 may have the respective height 134 of at least about 10, 15, 20, 25, 30, 35, or 40 millimeters (mm) or between about 10 to 40, 15 to 35, or 20 to 30 mm. In certain embodiments, the respective height 134 may be at least 5, 10, 15, or 20 percent of the total height of the insert 64 along the axial axis 90 or between about 5 to 20 or 10 to 15 percent of the total height of the insert 64 along the axial axis 90. In certain embodiments, the respective height 134 may be at least 2, 3, 4, 5, 6, 7, or 8 times greater than the respective height 126 of the one or more fixed protrusions 122 or between about 2 to 8 or 4 to 6 times greater than the respective height 126 of the one or more fixed protrusions 122. In certain embodiments, the fixed rib 124 may have a tapered geometry with respect to height (e.g., a wedge-shape or pie-shape; smaller height proximate to a radially inner end 152 as compared to distal from the radially inner end 152).

The fixed rib 124 may have the respective depth 136 of at least about 30, 50, 70, 100, 125, or 150 millimeters (mm) or between about 30 to 150, 50 to 125, or 70 to 100 mm. In certain embodiments, the respective depth 136 may be at least 20, 30, 40, 50, 60, 70, or 80 percent of the total radial depth of the insert 64 along the radial axis 92 or between about 20 to 80 or 30 to 70 percent of the total radial depth of the insert 64 along the radial axis 92. In certain embodiments, the respective depth 136 may be at least 5, 6, 7, 8, 9, 10, 11, or 12 times greater than the respective depth 128 of the one or more fixed protrusions 122 or between about 5 to 12 or 6 to 10 times greater than the respective depth 128 of the one or more fixed protrusions 122. Additionally or alternatively, the fixed rib 124 may extend radially inwardly of the radially inner surface 118, with at least about 10, 20, 25, 30, 35, 40, 45, or 50 millimeters (mm) of the respective depth 136 being positioned radially inwardly of the radially inner surface 118 and/or at least about 5, 10, 15, 20, 25, or 50 percent of the respective depth 136 being positioned radially inwardly of the radially inner surface 118. In certain embodiments, the fixed rib 124 may have a tapered geometry with respect to depth (e.g., the radially inner end 152 may be tapered, such as angled to face upwardly). Although the fixed rib 124 is shown to not extend radially inwardly of the radially inner ledge 112, it should be appreciated that the fixed rib 124 may extend radially inwardly of the radially inner ledge 112.

In certain embodiments, the respective width 138 of the fixed rib 124 may be greater than the width 120 of the intermediate body portion 114 and the one or more fixed protrusions 122 formed on the radially inner surface 118 of the intermediate body portion 114 of the intermediate portion 106. In certain embodiments, the respective width 138 of the fixed rib 124 may be less than respective widths of the seal portion 102 and the base portion 104 (e.g., the fixed rib 124 does not extend laterally beyond the seal portion 102 and the base portion 104). In certain embodiments, the fixed rib 124 may have a tapered geometry with respect to width (e.g., a wedge-shape or pie-shape; smaller width along the lateral axis 96 proximate to the radially inner end 152 as compared to distal from the radially inner end 152).

As shown, the fixed rib 124 may extend from the radially inner surface 118 at an angle 150 relative to the radial axis 92 (e.g., extend upwardly relative to the radial axis 92, such that the radially inner end 152 of the fixed rib 124 is axially and radially offset from a radially outer end 154 of the fixed rib 124, such as axially above and radially inward from the radially outer end 154 of the fixed rib 124). With the fixed rib 124 oriented to extend upwardly relative to the radial axis 92, the fixed rib 124 may be provided with the respective depth 136 that enables the fixed rib 124 to extend into and support radially inner portions of the elastomer body 62, while also being withdrawn from the central bore 44 in the open configuration 50 and/or avoiding contact with the tubular string 24 in the central bore 44 (see FIGS. 1-3). However, it should be appreciated that the fixed rib 124 may be oriented at any suitable angle, such as to be aligned with the radial axis 92 or to extend downwardly relative to the radial axis 92 (e.g., such that the radially inner end 152 of the fixed rib 124 is axially below and radially inward from the radially outer end 154 of the fixed rib 124).

The fixed rib 124 may include one or more openings 160 (e.g., through holes) to facilitate engagement with the elastomer body 62 shown in FIGS. 2 and 3. For example, the elastomer body 62 may be molded through and/or extend to fill the one or more openings 160. In FIGS. 4 and 5, the one or openings 160 include an elongated shape (e.g., oval shape; longer with respect to depth than height); however, it should be appreciated that the one or more openings 160 may have any suitable size and/or shape to facilitate engagement with the elastomer body 62. Further, the one or more openings 160 may include any suitable number of openings, such as 1, 2, 3, 4, 5, or more, in any suitable arrangement along the fixed rib 124. While FIGS. 4 and 5 illustrate the single fixed rib 124, it should be appreciated that the one or more fixed ribs 124 may include any suitable number of fixed ribs 124, such as 1, 2, 3, 4, 5, or more, in any suitable size(s), shape(s), and/or arrangement(s). For example, the one or more fixed ribs 124 may include multiple fixed ribs 124 stacked along the axial axis 90 or arranged in any suitable pattern. In some such cases, the multiple fixed ribs 124 may have a same size, shape, and/or angle. In some such cases, the multiple fixed ribs 124 may have different sizes, shapes, and/or angles. Indeed, it should be appreciated that any combination of sizes, shapes, and/or angles may be implemented with the multiple fixed ribs 124 to facilitate adhesion and/or engagement with the elastomer body 62.

As shown in FIGS. 4 and 5, the insert 64 may additionally or alternatively include the one or more structural features as one or more fixed indentations 176 (e.g., grooves, recesses, troughs, openings). In certain embodiments, the one or more fixed indentations 176 may include multiple fixed indentations 176 formed or defined along the side surfaces 116 of the intermediate body portion 114 of the intermediate portion 106 of the insert 64. For example, the one or more fixed indentations 176 may include the multiple fixed indentations 176 that define a pattern (e.g., separated from one another and stacked along the axial axis 90).

While the one or more fixed indentations 176 are shown as a trough (e.g., depression that extends between about 1 to 12, 2 to 10, 3 to 8, or 4 to 6 millimeters (mm) into a respective surface or between about 1 to 25 or 5 to 10 percent across the insert 64), it should be appreciated that the one or more fixed indentations 176 may additionally or alternatively include openings (e.g., through holes) that extend between and are open to multiple surfaces (e.g., opposed surfaces; both of the side surfaces 116; both of the side surfaces 132).

It should be appreciated that the one or more fixed indentations 176 may be provided along any suitable surface, such as any surface of the insert 64 that contacts and/or is adhered to the elastomer body 62 when assembled together as the packer 52 of FIGS. 2 and 3 (e.g., any elastomer-contacting surface of the insert 64). For example, the one or more fixed indentations 176 may be provided along the side surfaces 116 of the intermediate body portion 114 of the intermediate portion 106, along an axially facing surface 130 of the base portion 104, along one or more side surfaces 132 of the base portion 104, along one or more surfaces of the seal portion 102, and so forth. The one or more fixed indentations 176 may include any suitable size and/or shape (e.g., oval shape; longer with respect to depth than height) to facilitate engagement with the elastomer body 62 shown in FIGS. 2 and 3. Further, the one or more indentations 176 may include any suitable number of indentations, such as 1, 2, 3, 4, 5, or more, in any suitable arrangement on the insert 64.

Figure 7:
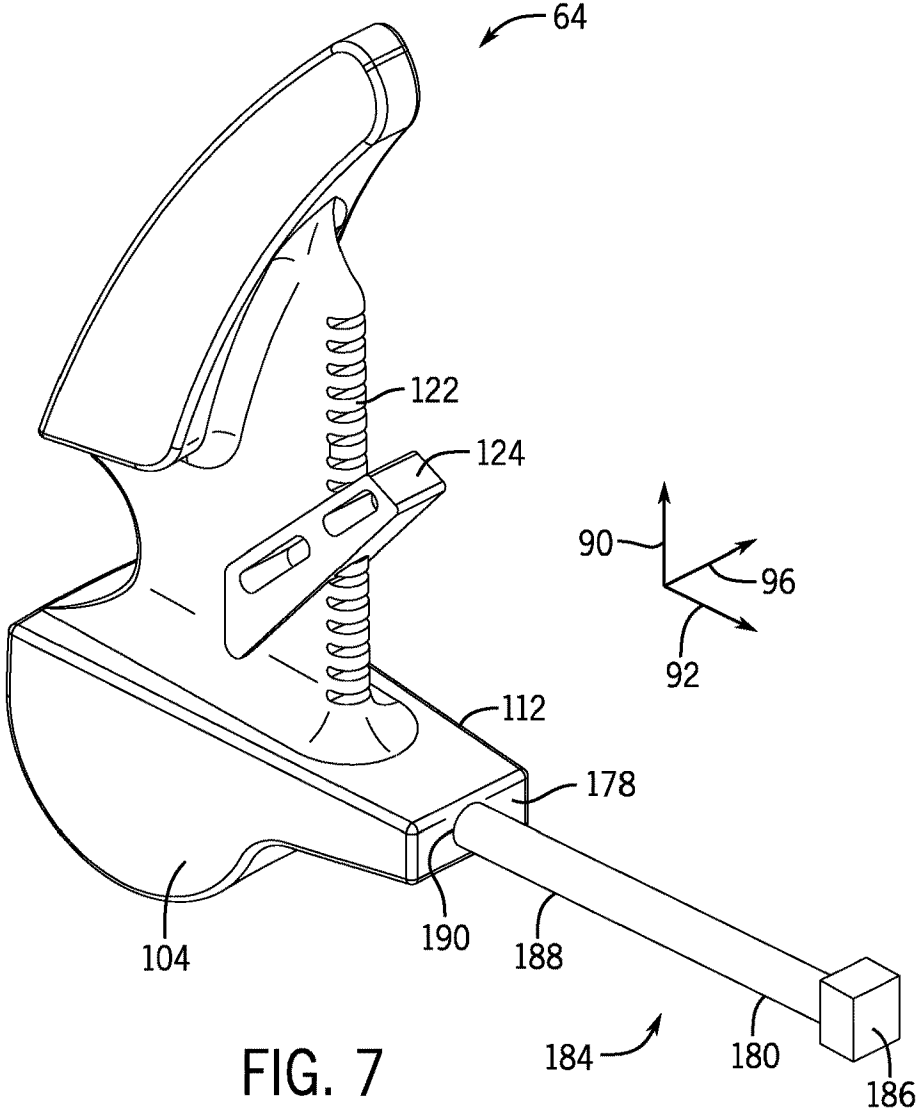
FIG. 7 is a perspective view of the insert of FIG. 6, wherein the movable rib is in an extended configuration, in accordance with an embodiment of the present disclosure.
Figure 6:
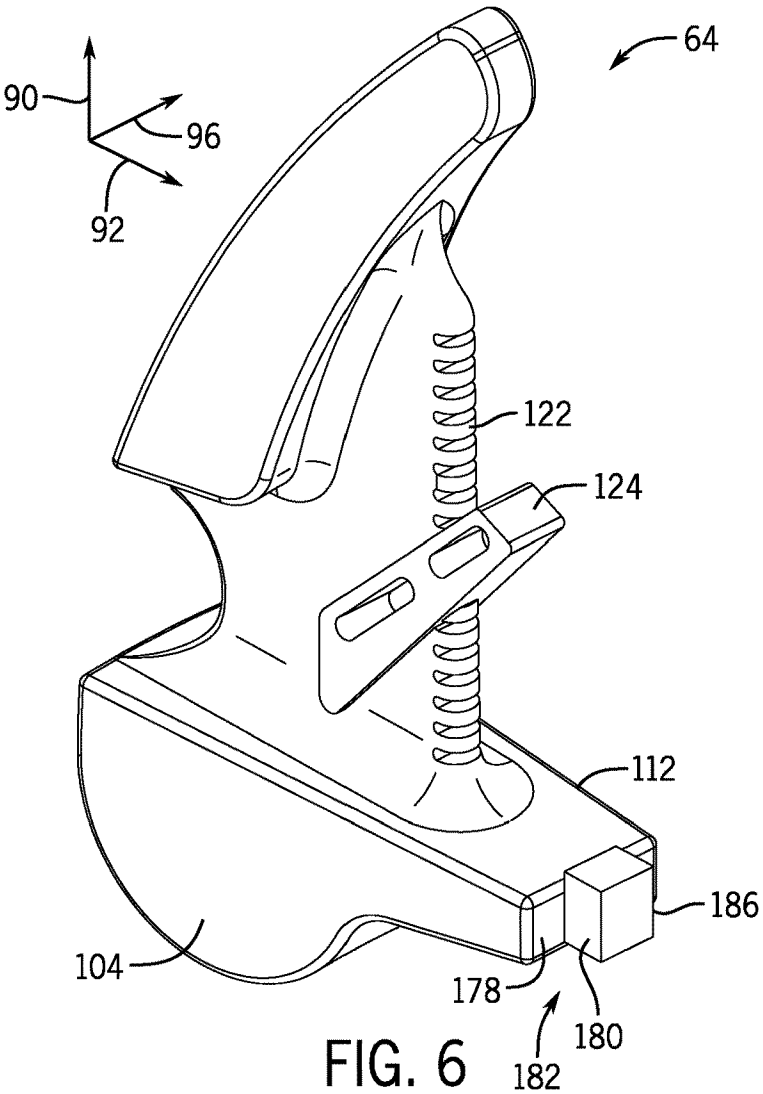
FIG. 6 is a perspective view of an insert that may be utilized in a packer of the annular BOP of FIG. 2, wherein the insert includes a movable rib that is in a retracted configuration, in accordance with an embodiment of the present disclosure.
Figure 9:
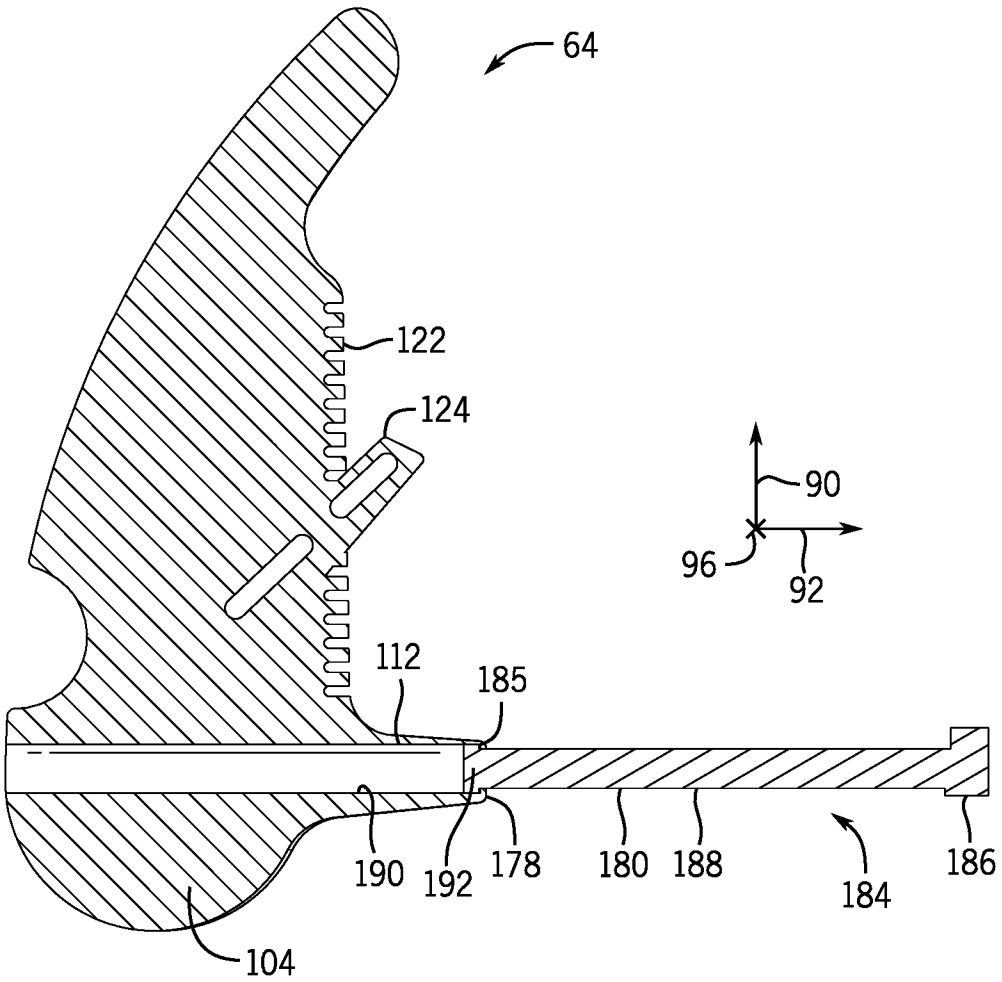
FIG. 9 is a side view of the insert of FIG. 6, wherein the movable rib is in the extended configuration, in accordance with an embodiment of the present disclosure.
Figure 8:
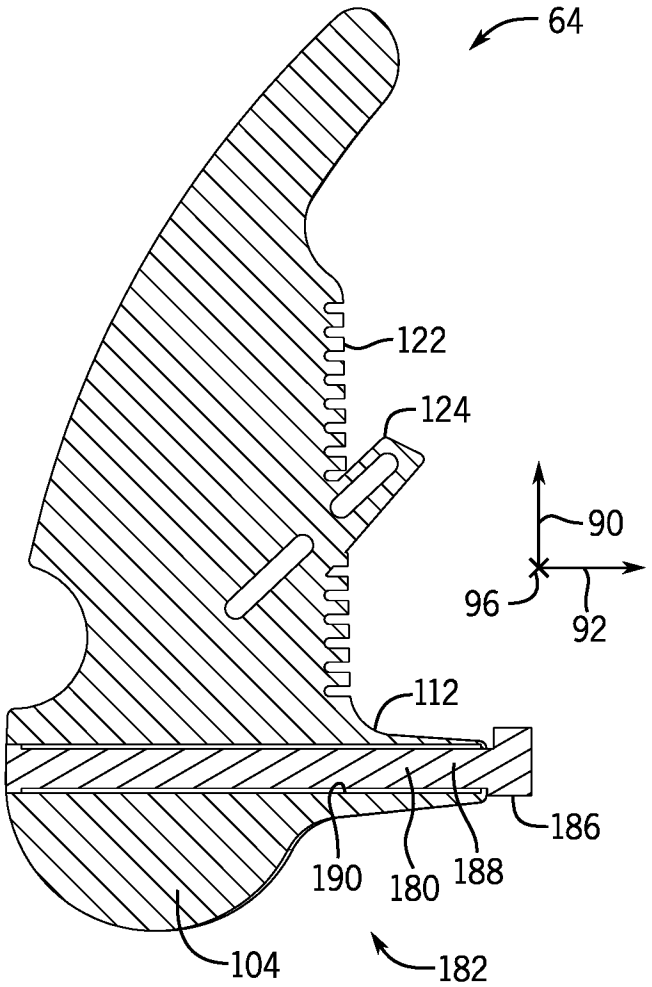
FIG. 8 is a side view of the insert of FIG. 6, wherein the movable rib is in the retracted configuration, in accordance with an embodiment of the present disclosure.

FIGS. 6 and 7 are perspective views of an embodiment of the insert 64 with a movable extension, such as a movable rib 180. FIGS. 8 and 9 are side views of the embodiment of the insert 64 with the movable extension, such as the movable rib 180. In FIGS. 6 and 8, the movable rib 180 is in a retracted configuration 182. In FIGS. 7 and 9, the movable rib 180 is in an extended configuration 184. In the retracted configuration 182, the movable rib 180 is withdrawn or retracted into the base portion 104 of the insert 64. In the extended configuration 184, the movable rib 180 extends from the base portion 104 of the insert 64.

As shown, the movable rib 180 is slidingly supported in a cavity 190 (e.g., passageway) formed in the base portion 104 of the insert 64. The cavity 190 may be open to and/or terminate at a radially inner surface 178 of the radially inner ledge 112 of the base portion 104 of the insert 64. The movable rib 180 may extend from a first end (e.g., radially outer end) to a second end (e.g., radially inner end). In certain embodiments, the first end may include a radially expanded stop portion 192 to engage a lip 185 of the cavity 190 to block the movable rib 180 from withdrawing entirely from the cavity 190 (e.g., to block separation of the movable rib 180 from the insert 64).

In certain embodiments, the second end may include a head portion 186 (e.g., a radially expanded head portion), which may be configured to contact the elastomer body 62 when the insert 64 is assembled with the elastomer body 62 to form the packer 52 shown in FIGS. 2 and 3. In particular, at least a portion of the head portion 186 may be bonded to the elastomer body 62. Further, at least the portion of the head portion 186 may remain outside of the cavity 190 even while other portions of the movable rib 180 are in the retracted configuration 182. Then, upon compression of the elastomer body 62 (e.g., due to movement of the piston 60, as shown and described with reference to FIGS. 2 and 3), the elastomer body 62 may apply a force (e.g., pull; radially inward) to the head portion 186 that causes the movable rib 180 to move (e.g., slide) within the cavity 190 to adjust the movable rib 180 from the retracted configuration 182 to the extended configuration 184. In this way, the movable rib 180 may move (e.g., automatically) with the elastomer body 62 to provide support to the elastomer body 62 (e.g., move to the extended configuration 184 as the elastomer body 62 moves to the compressed configuration to adjust the annular BOP 42 to the closed configuration 80, as described with reference to FIG. 3). Similarly, upon relaxation of the elastomer body 62 (e.g., due to release via movement of the piston 60, as shown and described with reference to FIGS. 2 and 3), the elastomer body 62 may apply an additional force (e.g., pull; radially outward) to the head portion 186 that causes the movable rib 180 to move (e.g., slide) within the cavity 190 to adjust the movable rib 180 from the extended configuration 184 to the retracted configuration 182. In this way, the movable rib 180 may move (e.g., automatically) with the elastomer body 62 to open or to clear the central bore 44 through the annular BOP 42 (e.g., move to the retracted configuration 182 as the elastomer body 62 moves to the relaxed configuration to adjust the annular BOP 42 to the open configuration 50, as described with reference to FIG. 2).

As shown, the movable rib 180 extends along the radial axis 92. However, it should be appreciated that the movable rib 180 may be oriented at an angle relative to the radial axis 92 (e.g., oriented upwardly or downwardly relative to the radial axis 92, such as to position the second end above or below the first end along the axial axis 90). Further, the movable rib 180 may have any suitable size and/or shape. For example, the movable rib 180 may include at least a portion, such as a support rod portion 188, with a cylindrical shape or any other suitable shape (e.g., rectangular cross-sectional shape and/or with a key/slot interface engagement in the cavity 190 to block rotation of the movable rib 180 relative to the base portion 104 of the insert 164). Similarly, the head portion 186 may have a cuboid shape, a spherical or curved shape, or any other suitable shape (e.g., it may be desirable to include one or more flat surfaces to facilitate bonding to the elastomer body 62).

While FIGS. 6-9 illustrate the movable rib 180, it should be appreciated that the insert 64 may include any suitable number of movable ribs 180, such as 1, 2, 3, 4, 5, or more, in any suitable size(s), shape(s), and/or arrangement(s). For example, the insert 64 may include multiple movable ribs 180 stacked along the axial axis 90 and/or the lateral axis 96. In such cases, any combination of sizes, shapes, and/or angles may be implemented with the multiple movable ribs 180 to facilitate adhesion and/or engagement with the elastomer body 62. As shown, the movable rib 180 (or the multiple movable ribs 180) may be utilized in combination with the one or more fixed structural features, such as the one or more extensions that may include the one or more fixed protrusions 122 and/or the one or more fixed ribs 124. Indeed, any of the features and/or geometries of the insert 64 described with reference to FIGS. 4-9 may be combined in any suitable manner.

Figure 10:
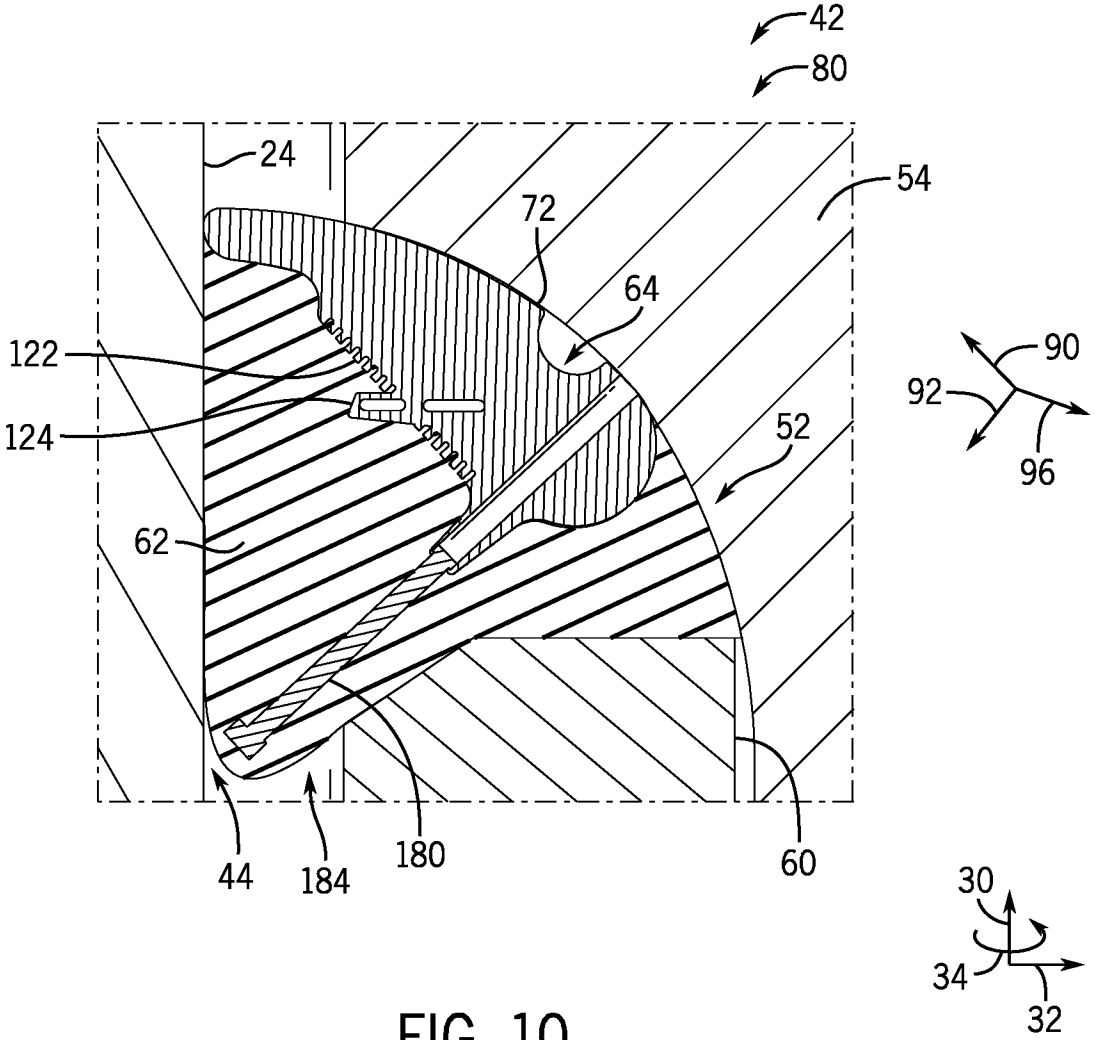
FIG. 10 is a perspective view of the insert of FIG. 6 coupled to an elastomer body, wherein the movable rib is in the extended configuration, in accordance with an embodiment of the present disclosure.

FIG. 10 is a perspective view of an embodiment of the insert 64 that includes the movable rib 180. In FIG. 10, the insert 64 and the movable rib 180 are coupled to the elastomer body 62 to form the packer 52 within the housing 54 of the annular BOP 42. Further, the piston 60 is positioned to apply force to compress the elastomer body 62 within the housing 54, which causes the elastomer body 62 to pull the movable rib 180 to the extended configuration 184 to support the elastomer body 62 (e.g., to support a center portion of the elastomer body 62 within the central bore 44).

In operation, the piston 60 may drive the packer 52 against the radially inner surface 72 of the housing 54, which may cause the elastomer body 62 to compress axially and expand radially to seal against the tubular string 24. The insert 64 (and multiple other inserts 64 within the elastomer body 62) may support the elastomer body 62 to maintain the seal against the tubular string 24 (e.g., in presence of high wellbore pressure). In particular, the one or more extensions, which may include the one or more fixed protrusions 122, the one or more fixed ribs 124, and/or the one or more movable ribs 180, may support the elastomer body 62 to maintain the seal against the tubular string 24 (e.g., in presence of high wellbore pressure). Further, the one or more extensions may provide improved peel resistance, improved adhesion, improved engagement, improved wear resistance, and so forth (e.g., compared to packers within the one or more extensions).

As shown, during transition to the closed configuration 80, the insert 64 moves within the housing 54 (e.g., pivots within the housing 54). Thus, while the movable rib 180 is described as being oriented along the radial axis 92 with respect to the insert 64 in FIGS. 6-9, it should be appreciated that the movable rib 180 may move at an angle relative to the radial axis 32 (e.g., downwardly along the axial axis 30) with respect to the housing 54 during operation, which enables the movable rib 180 to provide support to the elastomer body 62 (e.g., axially below the seal formed between the elastomer body 62 and the tubular string 24).

With reference to FIGS. 2 and 3, it should be appreciated that the multiple inserts 64 within the packer 52 may have any of a variety of different combinations of extensions (e.g., different types and/or geometries; different sizes, shapes, and/or angles). For example, only some of the multiple inserts 64 may include a respective movable rib 180 (e.g., only every other insert 64; alternating pattern). However, it may be desirable to maintain symmetry of the packer 52, such that opposed inserts 64 have similar or same geometries (e.g., diametrically opposed inserts 64 each include a respective movable rib 180).

While the one or more extensions described herein (e.g., the one or more fixed protrusions 122, the one or more fixed ribs 124, and/or the one or more movable ribs 180) are macrotextures (e.g., in size and scale), it should be appreciated that the insert 64 may additionally include microtexture(s) on any suitable surface of the insert 64 (e.g., any surface that may contact the elastomer body 62; on any surface that does not include or is devoid of the one or more extensions; on the one or more extensions, such as on the one or more fixed protrusions 122, the one or more fixed ribs 124, the one or more openings 160 of the one or more fixed ribs 124, and/or respective head portions 186 of the one or more movable ribs 180). For example, the microtexture(s) may include dimensions (e.g., height, depth, and/or width) less than 0.5 millimeters and/or a surface roughness (e.g., increased roughness as compared to a polished surface and/or as compared to other surfaces of the insert 64; due to texturing processes, such as sand-blasting and/or etching, applied to certain surfaces of the insert 64).

While certain examples provided herein relate to the annular BOP 42 and the packer 52 having the elastomer body 62 and the one or more inserts 64 with particular geometries, it should be appreciated that the one or more extensions described herein may be utilized in any of a variety of BOP types and with any of a variety of geometries. For example, the one or more fixed extensions (e.g., the one or more fixed protrusions 122 and/or the one or more fixed ribs 124) and/or the one or more movable extensions (e.g., the one or more movable ribs 180) may be utilized in a ram BOP, such as along rigid (e.g., metal) components that support an elastomer body (e.g., a packer body).

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims. Any features shown in FIGS. 1-10 and/or described with reference to FIGS. 1-10 may be combined in any suitable manner. For example, the one or more indentations shown in FIGS. 4 and 5 and described with reference to FIGS. 4 and 5 may be included in the insert shown in FIGS. 6-10.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A packer for a blowout preventer, the packer comprising:

an elastomer body; and one or more inserts coupled to the elastomer body, wherein at least one insert of the one or more inserts comprises:

an insert body with an elastomer-contacting surface; and one or more fixed extensions that extend from the elastomer-contacting surface to engage the elastomer body, wherein the one or more fixed extensions comprise at least one fixed rib that extends from the elastomer-contacting surface, and wherein the at least one fixed rib comprises one or more openings that are configured to receive respective portions of the elastomer body.

2. The packer of claim 1, wherein the one or more fixed extensions comprise a plurality of fixed protrusions formed along the elastomer-contacting surface and stacked along an axis.

3. The packer of claim 1, wherein the at least one insert of the one or more inserts comprises one or more fixed indentations formed in the elastomer-contacting surface or an additional elastomer-contacting surface of the insert body.

4. The packer of claim 1, wherein the at least one insert comprises a surface microtexture along the elastomer-contacting surface.

5. The packer of claim 1, wherein the at least one insert of the one or more inserts comprises at least one movable rib that is configured to move relative to the insert body between a retracted configuration and an extended configuration.

6. The packer of claim 1, wherein the elastomer-contacting surface comprises a radially inner surface of the insert body, and the one or more fixed extensions extend radially inwardly from the radially inner surface of the insert body.

7. The packer of claim 1, wherein the packer is an annular packer for use in an annular blowout preventer.

8. The packer of claim 7, wherein the one or more inserts comprise a plurality of inserts arranged circumferentially about the elastomer body.

9. The packer of claim 1, wherein the elastomer body comprises an elastomer material and the one or more inserts comprise a metal material.

10. An insert for a packer of a blowout preventer (BOP), the insert comprising:

an insert body comprising a radially inner surface, a first side surface, and a second side surface;

wherein at least one of the radially inner surface, the first side surface, or the second side surface comprises one or more fixed extensions to facilitate engagement with an elastomer body of the packer, and wherein the one or more fixed extensions comprise one or more fixed ribs that extend at an angle relative to a radial axis of the insert body, an axial axis of the insert body, or both.

11. The insert of claim 10, comprising at least one movable rib that is configured to slide within a cavity defined in the insert body to transition from a retracted configuration in which the at least one movable rib is withdrawn into the cavity and an extended configuration in which the at least one movable rib extends from the cavity.

12. An insert for a packer of a blowout preventer (BOP), the insert comprising:

an insert body; and one or more movable extensions that are configured to move between a retracted configuration in which the one or more movable extensions are withdrawn into the insert body and an extended configuration in which the one or more movable extensions extend from the insert body, wherein the insert body comprises a base portion, a seal portion, and an intermediate portion that couples the base portion to the seal portion, and wherein, in the retracted configuration, the one or more movable extensions are withdrawn into a cavity defined in the base portion of the insert body.

13. The insert of claim 12, wherein the one or more movable extensions are configured to slide along an axis relative to the insert body to move between the retracted configuration and the extended configuration.

14. The insert of claim 12, wherein the one or more movable extensions are configured to slide via forces applied to the one or more movable extensions by an elastomer body of the packer as the packer transitions between an open configuration and a closed configuration.

15. The insert of claim 12, comprising one or more fixed indentations formed in at least one elastomer-contacting surface of the insert body, one or more fixed extensions that extend from the at least one elastomer-contacting surface of the insert body, or both.

* * * * *